US012018913B2

(12) United States Patent
Tal et al.

(10) Patent No.: US 12,018,913 B2
(45) Date of Patent: Jun. 25, 2024

(54) ROCKET ARMAMENT LAUNCHABLE FROM A TUBULAR LAUNCHER WITH AN OUTSIDE LAUNCHER NON-IGNITION SECURING AND MOTOR SEPARATION DURING FLIGHT

(71) Applicant: RAFAEL ADVANCED DEFENSE SYSTEMS LTD., Haifa (IL)

(72) Inventors: Nadav Tal, Haifa (IL); Yossi Teper, Kiryat Bialik (IL); Evgeny Guller, Yokneam Ilit (IL); Jakov Ziv, Acre (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 485 days.

(21) Appl. No.: 17/262,607

(22) PCT Filed: Jul. 28, 2019

(86) PCT No.: PCT/IL2019/050852
§ 371 (c)(1),
(2) Date: Jan. 22, 2021

(87) PCT Pub. No.: WO2020/026233
PCT Pub. Date: Feb. 6, 2020

(65) Prior Publication Data

US 2021/0262756 A1 Aug. 26, 2021

(30) Foreign Application Priority Data

Jul. 30, 2018 (IL) ..... 260886

(51) Int. Cl.
*F41F 3/045* (2006.01)
*F42B 3/00* (2006.01)
(Continued)

(52) U.S. Cl.
CPC ..... *F41F 3/045* (2013.01); *F42B 3/006* (2013.01); *F42B 15/36* (2013.01); *F42B 30/04* (2013.01);
(Continued)

(58) Field of Classification Search
CPC .. F42B 5/10; F42B 5/105; F42B 15/36; F42B 15/38; F42B 39/20; F42C 15/28;
(Continued)

(56) References Cited

U.S. PATENT DOCUMENTS 2,644,364 A * 7/1953 Nass ..... F42B 5/10 89/1.818
2,655,105 A * 10/1953 Hansche ..... F42B 15/36 102/377
(Continued)

FOREIGN PATENT DOCUMENTS

| | | | |
|---|---|---|---|
| EP | 2293007 | A2 | 3/2011 |
| GB | 872588 | A | 7/1961 |
| WO | 03046359 | A1 | 6/2003 |

OTHER PUBLICATIONS

FN SCAR; Enhanced Grenade Launching Module. Retrieved from: https://en.wikipedia.org/wiki/FN_SCAR#Enhanced_Grenade_Launching_Module on Mar. 10, 2021. 13 pages.
(Continued)

*Primary Examiner* — Gabriel J. Klein
(74) *Attorney, Agent, or Firm* — Rodney J. Fuller; BOOTH UDALL FULLER, PLC

(57) ABSTRACT

Rocket armament launchable from a tubular launcher with an outside launcher non-ignition securing and motor separation during flight and a method to prevent the ignition of the armaments rocket even in the event of actuation of the armaments pyrotechnic assembly, which normally serves to eject the armament from the launcher and to ignite its rocket
(Continued)

motor, wherein the armament comprises a gas dispersion assembly, which when the armament is not encased in the tubular launcher, prevents the ignition of the rocket motor even if the armaments pyrotechnic assembly is actuated; and a cutting and separation assembly that is actuated by the pressure of the rocket motor gases for mechanically cutting a structural connection between the rocket motor and the armaments effective payload and separate them during their flight.

5 Claims, 10 Drawing Sheets

(51) Int. Cl.

| | |
|---|---|
| ***F42B 15/36*** | (2006.01) |
| ***F42B 30/04*** | (2006.01) |
| ***F42B 39/20*** | (2006.01) |
| ***F42C 15/28*** | (2006.01) |
| ***F42C 15/31*** | (2006.01) |

(52) U.S. Cl.
CPC ..... *F42B 39/20* (2013.01); *F42C 15/28* (2013.01); *F42C 15/31* (2013.01)

(58) Field of Classification Search
CPC ..... F42C 15/30; F42C 15/31; F42C 19/0819; F41F 3/045; F41F 3/0455
See application file for complete search history.

(56) References Cited

U.S. PATENT DOCUMENTS

| | | | | | |
|---|---|---|---|---|---|
| 2,976,804 | A | | 3/1961 | Hickman | |
| 3,070,015 | A | * | 12/1962 | Ledwith | F42B 15/36 403/31 |
| 3,176,615 | A | * | 4/1965 | De Matthew | F42B 5/10 102/375 |
| 3,457,861 | A | | 7/1969 | Crockett | |
| 3,771,455 | A | * | 11/1973 | Haas | F42B 12/64 102/377 |
| 3,855,932 | A | * | 12/1974 | Parker | F42B 15/36 102/378 |
| 4,198,896 | A | * | 4/1980 | Lamic | F02K 9/763 102/377 |
| 5,390,487 | A | * | 2/1995 | Moore | F02K 9/95 102/222 |
| 5,792,981 | A | * | 8/1998 | Singer | F42B 39/20 60/223 |
| 7,051,511 | B2 | * | 5/2006 | Prytz | F42B 39/20 60/770 |
| 7,793,591 | B1 | | 9/2010 | Van Stratum | |
| 8,220,392 | B1 | | 7/2012 | Maldonado | |
| 8,925,463 | B1 | * | 1/2015 | Sullivan | F42B 39/20 102/469 |
| 9,995,563 | B2 | * | 6/2018 | Redeker | F42B 33/001 |
| 2003/0079464 | A1 | * | 5/2003 | Solberg | F42B 15/00 60/253 |
| 2010/0122640 | A1 | * | 5/2010 | Ljungwald | F42B 39/20 102/481 |
| 2011/0048267 | A1 | | 3/2011 | Lee | |
| 2017/0343329 | A1 | | 11/2017 | Teper | |
| 2018/0135953 | A1 | * | 5/2018 | Bruno | F42B 33/02 |

OTHER PUBLICATIONS

M320 Grenade Launcher Module; retrieved from: https://en.wikipedia.org/wiki/M320_Grenade_Launcher_Module on Mar. 10, 2021. 5 pages.

* cited by examiner

ROCKET ARMAMENT LAUNCHABLE FROM A TUBULAR LAUNCHER WITH AN OUTSIDE LAUNCHER NON-IGNITION SECURING AND MOTOR SEPARATION DURING FLIGHT

CROSS-REFERENCE TO RELATED APPLICATIONS

This application is the U.S. National Stage of International Patent Application No. PCT/IL2019/050852, filed on Jul. 28, 2019, which claims the benefit of and priority to Israeli Patent Application No. 260886, filed on Jul. 30, 2018, the contents of each of which are hereby incorporated by reference in their entireties.

FIELD OF THE INVENTION

The various embodiments described herein generally relate to a man-portable rocket armament that can be carried and launched by an individual soldier, and the invention that is the subject of the Patent Application focuses on the safety aspects of this type of armament and its effective launching method.

BACKGROUND OF THE INVENTION

The urbanization of existing and potential fields of combat is emerging as a worldwide trend, and creates scenarios that call for combat in an urban environment. Such scenarios challenge the combatants to breech walls of buildings, cope with an enemy hiding behind walls and inside buildings in the urban environment. At the same time, urban warfare restricts the ability of combatants to make use of standoff operable supporting armament, such as tank gunfire or arms installed in weapon stations mounted on an armored combat vehicle due to the limited maneuverability of the vehicle in the urban environment and the vulnerability of the vehicle to be hit at close range from any window, opening in the wall and building corner.

As a result, man-portable armaments are being developed that can be carried by the individual soldier and allows him to launch an effective payload, for example an explosive charge (which is required, for example, for breaching doors, walls, and fortifications), similar to and instead of a cannon shell that is not applicable as aforesaid—within relatively short ranges and during the combatant's movement in an urban area.

Thus, for example, a portable armament is known in the art that enables launching an effective payload from a closed space (for example from within a room) without exposing the combatant to the danger of rocket flame (flash), (the armament known as FFE—Fired From Enclosure); armament that enables launching such a charge from a launcher positioned for such purpose on the combatant's shoulder (e.g. launching a rocket from a tubular launcher—a single-use disposable canister such as the LAW rocket), (the weapon known as SFW—Shoulder Fired Weapon); and armament that enables launching such charge from a tubular launcher that is a dedicated grenade launcher (e.g. Nammo Talley M320 EGLM-Enhanced Grenade Launching Module), or a grenade launcher fitted on the combatant's personal rifle (e.g. M203).

For the sake of completeness, it should be noted that such armaments may be launched by the individual soldier in using aiming and/or precise guidance systems, whereby the armament is fitted with sophisticated fuses. For example, devices that enable precise detonation of the effective payload when passing above a concealment wall or to give another example, the initiation of the effective payload only after its kinetic breach of the wall and upon entering the room.

The growing prevalence of such man-portable armaments that can be carried by the individual soldier and enable him to launch an effective payload (such as explosives, smoke, incendiary or other charges), within relatively short distances and while moving in the urban environment, require the combatant to carry one armament or more, for a long time and close to his body, which contains in its structure explosive and inflammable components that are inherently sensitive, and which intrinsically jeopardize the safety of the combatant carrying them and his immediate surrounding (fellow combatants that are in close proximity to the combatant carrying such armament).

For example, such a typical armament comprises a pyrotechnic assembly for ejecting a rocket motor to which the effective payload is connected and distancing them from the launching solider even before the rocket motor is ignited by the pyrotechnic assembly (so as not to expose the launching soldier and fellow soldiers to the flame of the rocket motor). Once the rocket motor is ignited, at a distance from the combatant, the motor continues to carry the effective payload to its destination. The components of the pyrotechnical assembly and the rocket motor pose an inherent safety risk, as previously stated.

The pyrotechnic assembly may be of the type that is actuated upon piercing, and an inadvertent and involuntary piercing could not only cause the combustion of the pyrotechnic assembly, but also the ignition of the rocket motor when the armament is still carried on the combatant's body or in immediate proximity to him and thereby endanger the soldier and his fellow soldiers.

Furthermore, a rocket motor usually comprises a relatively heavy body member, as needed to contain the energy producing substance (propellant) and the gas buildup inside it once the substance is ignited. Once the propellant has combusted, the body member of the rocket motor not only adds unnecessary weight that continues to be connected to the effective payload during its flight, while unnecessarily weighing down and possibly impairing the aerodynamic performances, but in close confrontation (i.e. in an urban environment), once the effective payload is detonated, the body member which in itself is heavy, could be thrust backwards, as unnecessary and dangerous shrapnel, at the combatant and his fellow soldiers and endanger them.

Thus, there was a need before the priority date to minimize the safety hazards posed by rocket armaments that are carried and launched by the individual soldier and to improve their effective launch.

SUMMARY OF THE INVENTION

The invention that is the subject of the Patent Application meets the aforesaid need to minimize the safety hazards posed by rocket armaments that can be carried and launched by an individual soldier and improve their effective launch.

Aspects and embodiments are directed to a rocket armament launchable from a tubular launcher that comprises an effective payload, a rocket motor that is structurally connected to the effective payload and adapted, once ignited, for propelling the effective payload towards the target, and a pyrotechnic assembly that has been adapted, once actuated, to eject the rocket motor and the effective payload from the tubular launcher and ignite the rocket motor. A rocket armament, which according to the invention is characterized in that the armament also comprises— a. A gas dispersion assembly, which when the rocket armament is not contained in the tubular launcher, secures non-ignition of the rocket motor even if the pyrotechnic assembly is actuated; and b. A cutting and separation assembly that is activated by the pressure of the rocket motor gases for mechanically cutting the structural connection between the rocket motor and the effective payload and separate them during flight.

According to another embodiment the invention that is the subject of the Patent Application is embodied in a gas dispersion assembly of a pyrotechnic assembly that can be installed in a rocket armament launchable from a tubular launcher from the time of actuation of the pyrotechnic assembly. The gas dispersion assembly prevents the ignition of the armament's rocket motor as long as the armament is not contained in a tube and despite the actuation of the pyrotechnic assembly.

According to another embodiment the invention that is the subject of the Patent Application is embodied in a cutting and separation assembly, which is actuated by gas pressure of the armament's rocket motor in order to mechanically cut the structural connection between the armament's rocket motor and the effective payload and their separation during the flight of the armament.

According to another embodiment the invention that is the subject of the Patent Application is embodied in a method to prevent ignition of an armament's rocket motor that is launchable from a tubular launcher, even in the event of actuation of the pyrotechnic assembly that normally serves to eject the armament from the launcher and ignite the rocket motor.

According to another embodiment the invention that is the subject of the Patent Application is embodied in a method that is applicable in a rocket-based armament for mechanically cutting the structural connection between the rocket motor and the effective payload and their separation from each another.

Still other aspects, embodiments, and advantages of these exemplary aspects and embodiment are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION OF PREFERRED EMBODIMENT

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Figure 1:
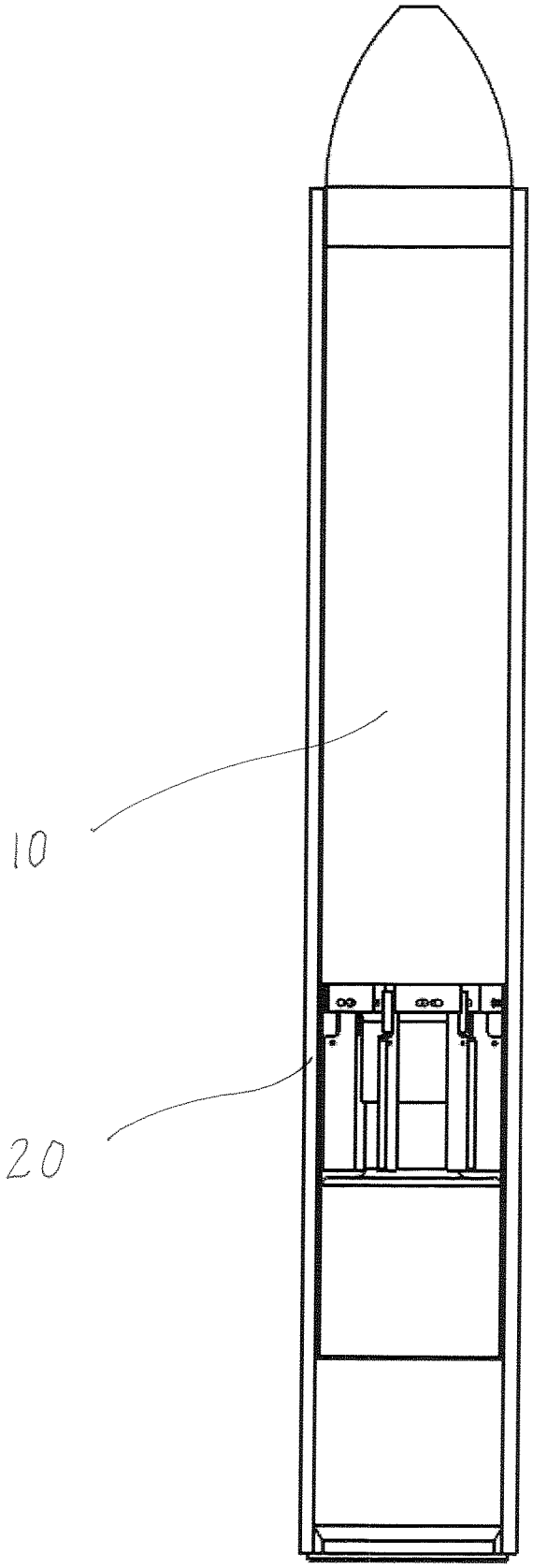
FIG. 1 depicts a cross-section of a rocket armament launchable from a tubular launcher, which structurally embodies the invention (in the illustrated example—said armament being 40 mm in diameter) wherein it is contained in the tubular launcher (e.g. a grenade launcher or single-use disposable canister).
Figure 2A:
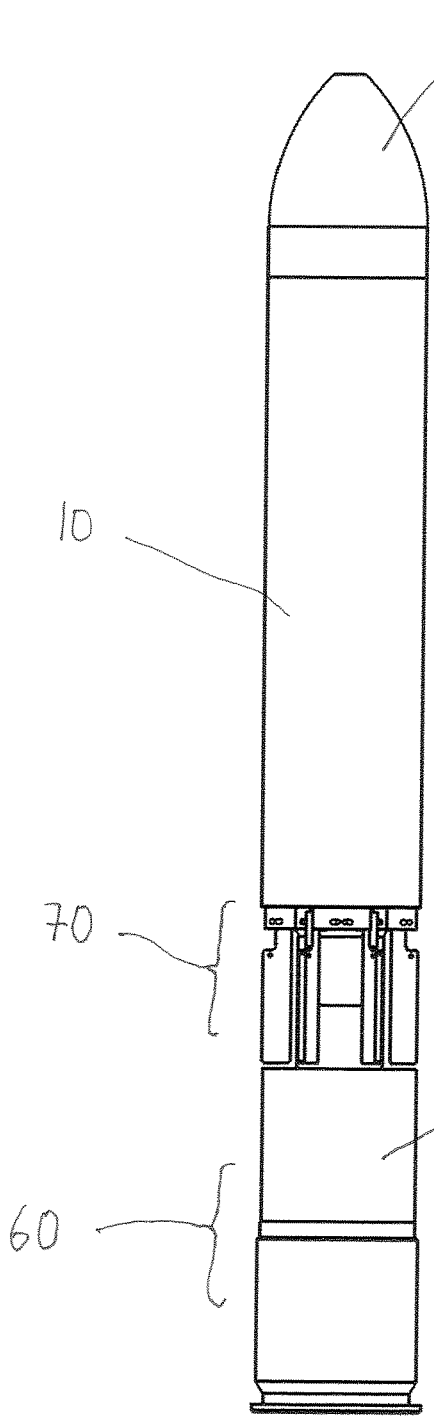
FIG. 2*a* is a view of the armament as illustrated in FIG. 2.
Figure 2:
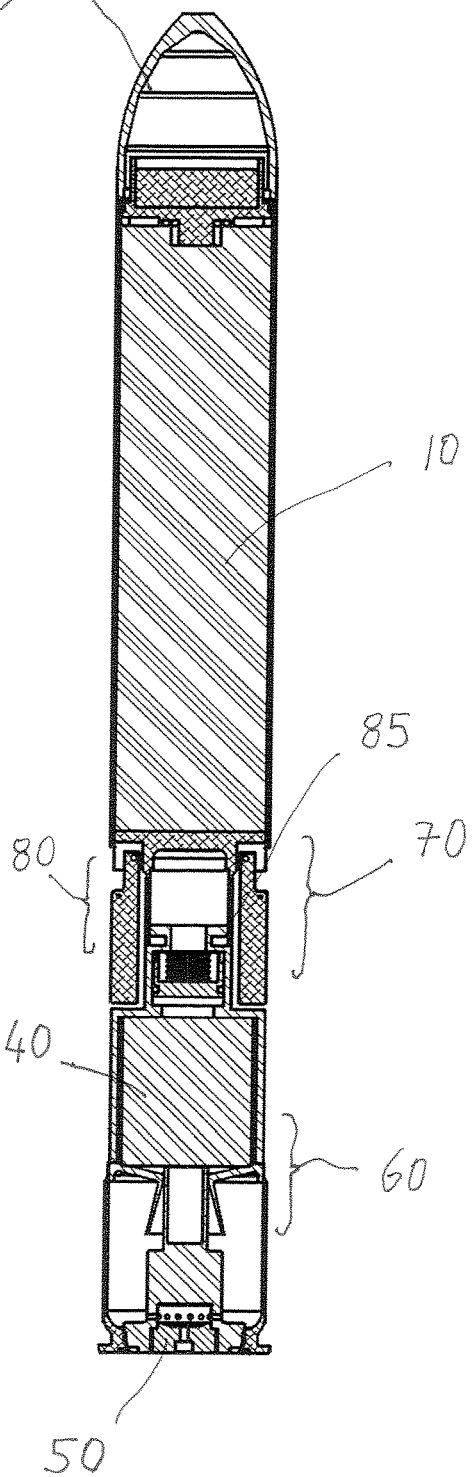
FIG. 2 is a cross-section view of the armament illustrated in FIG. 1 wherein it is outside the tubular launcher.

Reference is made to FIGS. 1, 2 and 2*a*. FIG. 1 is a cross-section view of an example of rocket armament 10, which is launchable from tubular launcher 20, wherein it is incorporated in the tubular launcher. FIG. 2 is a cross-section view of armament 10 when it is outside tubular launcher 20. FIG. 2*a* is a view of armament 10 (as illustrated in FIG. 2). As will be explained below, armament 10 structurally embodies the invention.

In the illustrated example, the armament is 40 mm in diameter, which is illustrated wherein it is incorporated in a tubular launcher that could be a barrel of a grenade launcher or a single-use disposable canister, but any skilled person will understand that this is only an example, and a rocket armament launchable from a tubular launcher that structurally embodies the invention may be of various other types and diameters.

Rocket armament 10, which, as stated, is launchable from tubular launcher 20, usually comprises effective payload 30, rocket motor 40 that is connected to effective payload 30, and is designed upon ignition to propel effective payload 30 towards a target (which is not illustrated—e.g. a door, wall or window of a building), and pyrotechnic assembly 50 that is adjusted upon its actuation to eject the rocket motor, connected to the effective payload, outside the tubular launcher and ignite the rocket motor.

Rocket armament 10 is characterized by that the armament also comprises gas dispersion assembly 60, which as will be explained below in referring to FIGS. 3-5, when rocket armament 10 is not contained in tubular launcher 20, the ignition of rocket motor 40 is prevented by the gas dispersion assembly, even if pyrotechnical assembly 50 is actuated. Another feature of rocket armament 10 is that it also comprises cutting and separation assembly 70, which, as explained below in reference to FIGS. 6-10, is actuated by gas pressure of rocket motor 40 in order to mechanically cut structural connection 80 (in the illustrated example—threaded interface 85), which normally harnesses rocket motor 40 to effective payload 30 (to form a single armament unit), and upon completion of the assembly's operation, causes rocket motor 40 to separate from effective payload 30 during the flight of the armament towards the target.

In light of the explanations given below with reference to the accompanying figures, a skilled person will understand that in addition to rocket armament 10, which incorporates the two assemblies 60 and 70 in its structure, a rocket armament according to the invention may be one that structurally embodies only one of the assemblies indicated above—only the gas dispersion assembly of a pyrotechnic assembly that can be fitted in any rocket-based armament, wherein the armament is of the type that is launchable from a tubular launcher upon actuation of the pyrotechnic assembly, in order to prevent the ignition of the armament's rocket motor as long as it is not inside the tube and notwithstanding the actuation of the pyrotechnic assembly, or only the cutting and separation assembly, which is actuated by the pressure of rocket motor gases, and can be installed in any rocket armament in order to mechanically cut a structural connection between the rocket motor and the effective payload of the armament and separate them from each other while the armament is in flight.

Figure 3:
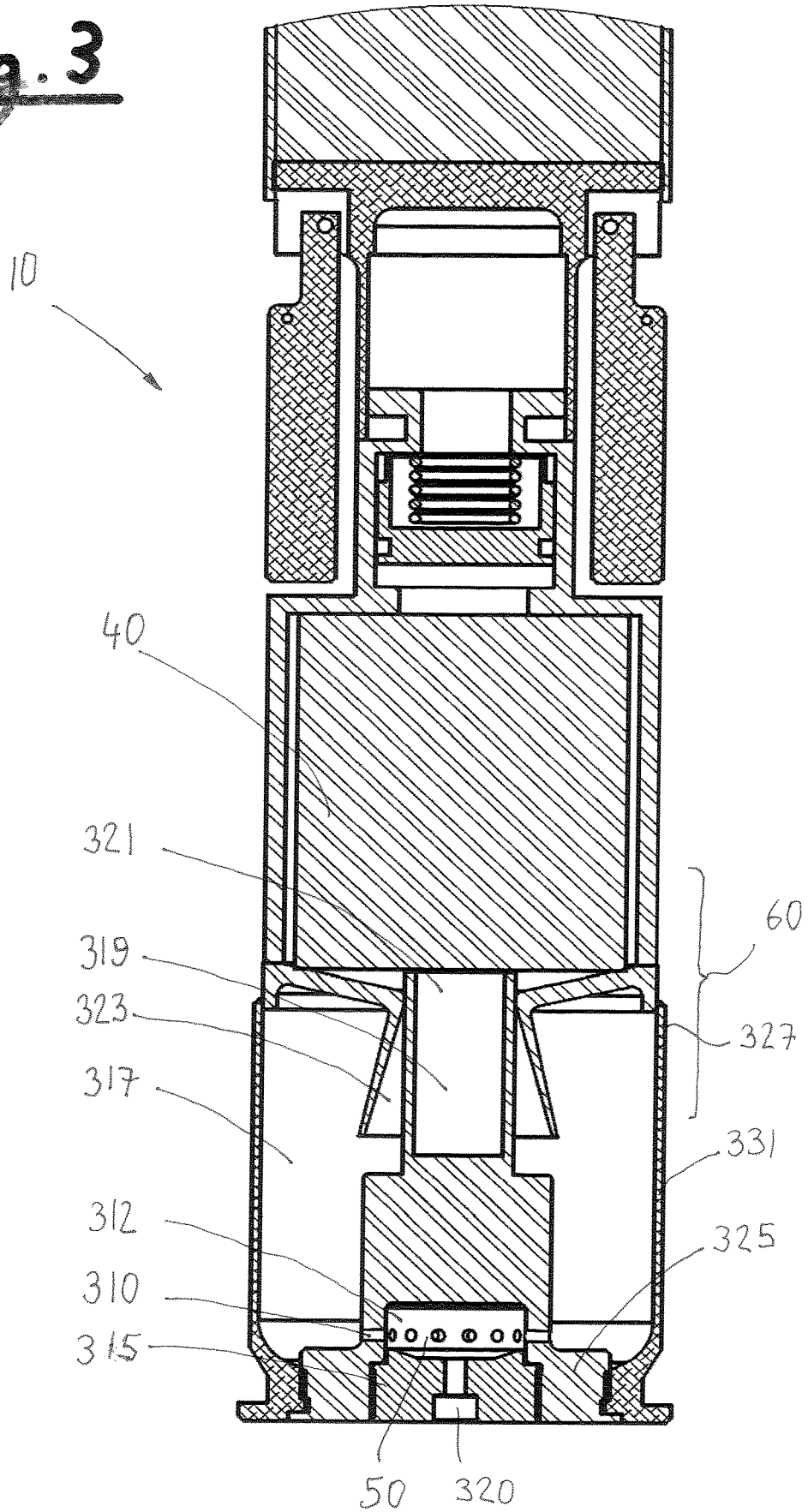
FIG. 3 is a close-up cross-section view of a gas dispersion assembly according to the invention, as embodied in the armament illustrated in FIG. 1.
Figure 4:
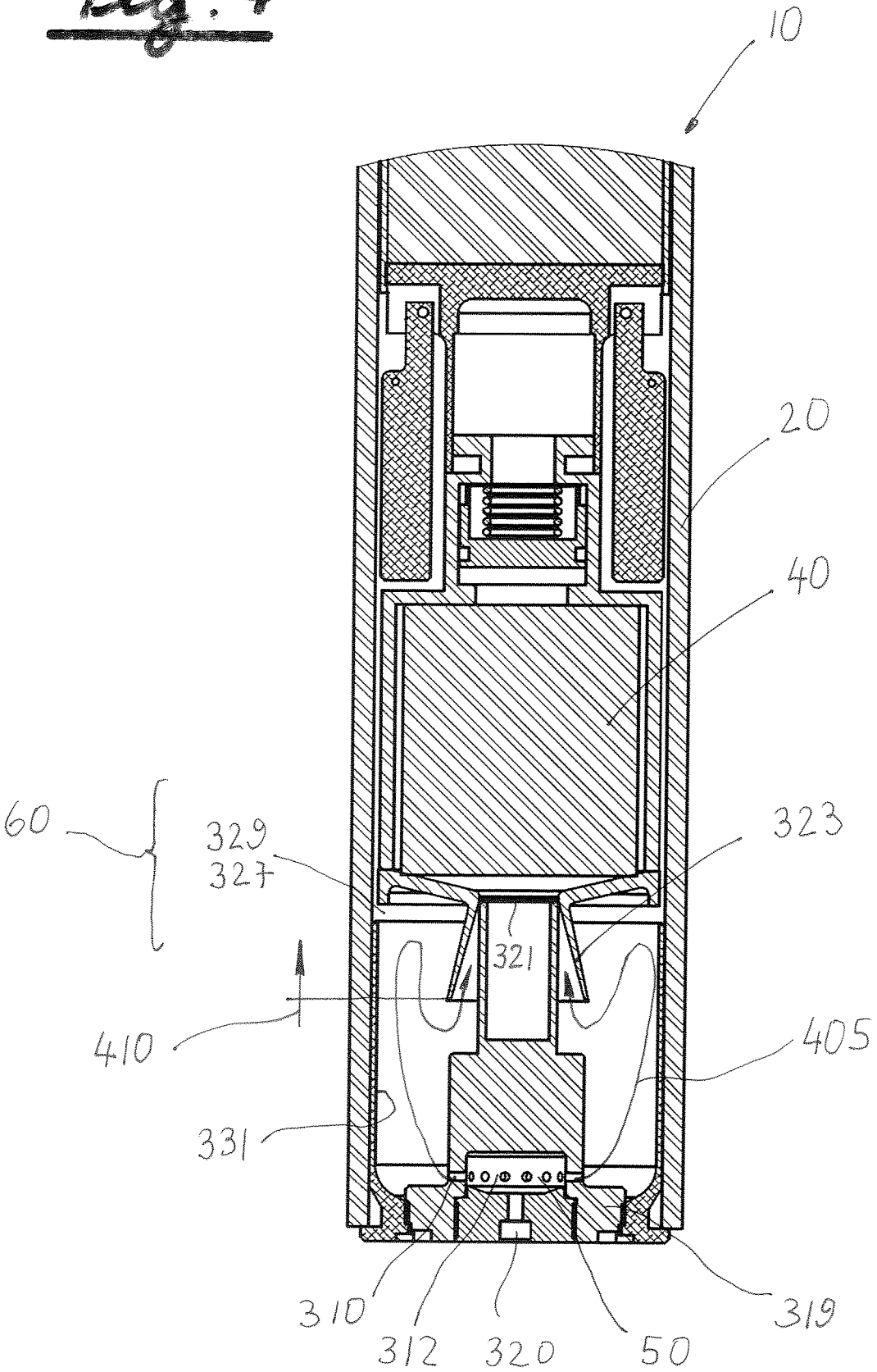
FIG. 4 is a close-up cross-section view illustrating the mode of operation of the gas dispersion assembly illustrated in FIG. 3, as it operates after the pyrotechnic assembly is intentionally actuated (when the armament is contained in the tubular launcher)—igniting the rocket motor.
Figure 5:
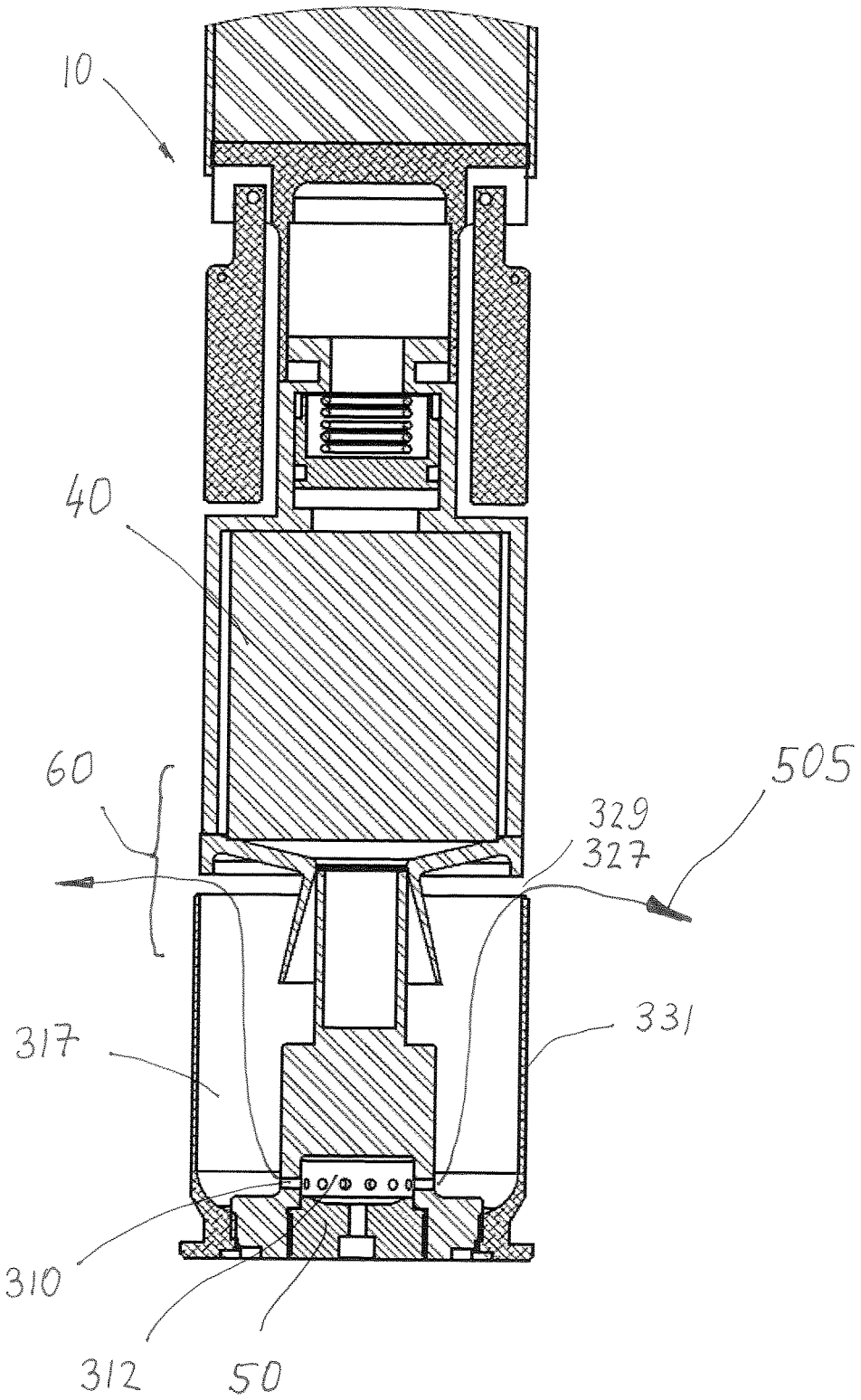
FIG. 5 is a close-up cross-section view illustrating the mode of operation of the gas dispersion assembly illustrated in FIG. 3, following the inadvertent (undesired) actuation of the pyrotechnic assembly (when the armament is outside the tube launcher and is not contained inside it)—gas dispersion without igniting the rocket motor.

Reference is made to FIGS. 3-5. FIG. 3 is a close-up view of a cross-section of gas dispersion assembly 60, as embodied in armament 10. FIG. 4 is a close-up cross-section view illustrating the mode of operation of gas dispersion assembly 60 after the intentional actuation of pyrotechnic assembly 50 (i.e. when the armament is inside tubular launcher 20), for the intended ignition of rocket motor 40 (and to eject the rocket motor, when it is connected to the effective payload, outside the launcher and initiate full ignition of the rocket motor, as required of an armament that must distance the rocket motor flame from the launching combatant and his surroundings). FIG. 5 is a close-up cross-section view illustrating the mode of operation of gas-dispersion assembly 60, following an inadvertent (undesired) actuation of pyrotechnic assembly 50 (when the armament is outside the tube launcher and is not inside it) for dispersing the gas without igniting the rocket motor.

According to the illustrated example, gas dispersion assembly 60 comprises multi-nozzle array 310 that is formed around high pressure buildup chamber 312 and is connected to it. Located at one end of high pressure buildup chamber 312 is cartridge 315, which is a pyrotechnic unit in pyrotechnic assembly 50. Pyrotechnic assembly 50 also includes pierceable pyrotechnic element 320, which once pierced, actuates cartridge 315. (However, a skilled person understands that this is just an example, and the cartridge may be actuated also by an electric igniter). Cartridge 315 serves to produce a mass of flaming hot gases that build up in high pressure buildup chamber 312 and are then routed to flow through nozzle array 310. Gas dispersion assembly 60 is also formed with low pressure buildup chamber 317. Low pressure buildup chamber is connected to the hot gas mass that flow into it from nozzle array 310. Gas dispersion assembly 60 also includes bushing member 319, which is shaped like a piston, one end of which is 321, which is normally located (see FIG. 3) in ejection nozzle 323 of rocket motor 40 in a way that blocks the passage into the rocket motor. The other end—325, of bushing member 319, is formed with a seating for fitting cartridge 315 inside, with high pressure buildup chamber 312 and multi-nozzle array 310. Gas dispersion assembly 60 also includes dispersing openings array 327, which is connected to the gas mass flow through them from low pressure buildup chamber 317 to the environment (as long as the gas path is not blocked by the inner surface of tubular launcher 20, once the armament is in the launcher that encases it). According to the illustrated example, dispersing openings array 327 is formed as a sort of spacing slit 329 on the circumference of the interface between rocket motor 40 and pyrotechnic assembly housing member 331 (the housing member within which are fitted pyrotechnic assembly 50, cartridge 315, pierceable element 320, bushing member 319, and it encloses in its cylindrical configuration low pressure buildup chamber 317).

A skilled person will understand that dispersing openings array 327 may also include an o-ring gasket that can be broke open by gas pressure (not illustrated), which also serves as a separable connection and sealing interface between rocket motor 40 and housing member 331, or may have another configuration (e.g. an openings array that can be broke open by gas pressure that is formed on the circumference of the connection and sealing interface).

When armament 10 is contained in tubular launcher 20 (the configuration illustrated in FIG. 4), then—immediately after the intentional actuation of pyrotechnic assembly 50, the hot gases accumulating in low pressure buildup chamber 317 (after passing into it from high pressure building chamber 312 through nozzles array 310), cannot be dispersed into the environment—dispersing openings array 327 is positioned while it is encased by the interior surface of tubular launcher 20, and the path of the gas to the environment is therefore blocked (see arrows pattern 405). The hot gas mass is therefore routed, at least most of it, to rocket motor 40, causing it to be pushed forward within the launcher (in the direction of arrow 410), while creating a passage space between end 321 of bushing member 319 and the rocket motor's ejection nozzle 323. The passage space that is formed allows the passage of the hot gas mass and its entry into the rocket motor, as needed to ignite it. At the same time, the intentional actuation of pyrotechnic assembly 50 within launcher 20 separates the connection and sealing interface between rocket motor 40 and housing member 331, thereby leading to the ejection of the ignited rocket motor, to which the effective payload is connected, outside the launcher, while leaving members of pyrotechnic assembly 50 (including pyrotechnic housing assembly 331) in the launcher, for discharge from there at the post-launch stage.

When armament 10 is outside the launcher (the illustrated configuration in FIG. 5), then—in the event of an unintentional actuation of pyrotechnic assembly 50, the hot gases accumulating in low pressure buildup chamber 317 (after their passage into it from high pressure buildup chamber 312 through nozzles array 310) may be dispersed into the environment—dispersing openings array 327 allows for the emission of the gases, at least most of them, since the path of the gases to the environment is not blocked (as the armament is not encased in the tubular launcher), (see arrows pattern 505). Most of the hot gas mass is therefore routed to be dispersed into the environment, and only a small percentage finds its way to rocket motor 40, so that even if the motor shifts slightly, the gas energy that penetrates the rocket motor is insufficient to ignite it.

A skilled person will appreciate the fact that the mode of operation of the gas dispersion assembly according to the invention applies a general method that is also applicable in various other rocket armaments. A method that is applicable in armaments that are contained in an encasement member (the tubular launcher here) only prior to and immediately before launch, in a manner that routes the gases formed from the actuation of the pyrotechnic assembly to the rocket motor, as needed in order to ignite it, and when there is no such encasement, at least some of the gas is dispersed into the environment and the rest is insufficient to ignite the rocket motor. A general method, which includes the stage of positioning a dispersing openings array (327 in the illustrated example), which are connected to the flow through them of gases formed from actuation of a pyrotechnic assembly (50 in the illustrated example), while diverting said gases from a rocket motor and therefore preventing its ignition, and a stage of encasing a dispersing openings array by means of an encasement member (tubular launcher 20 in the illustrated example), in a manner that routes the gases formed from the actuation of a pyrotechnic assembly (50 in the illustrated example) to the rocket motor, as needed to ignite it.

Figure 6:
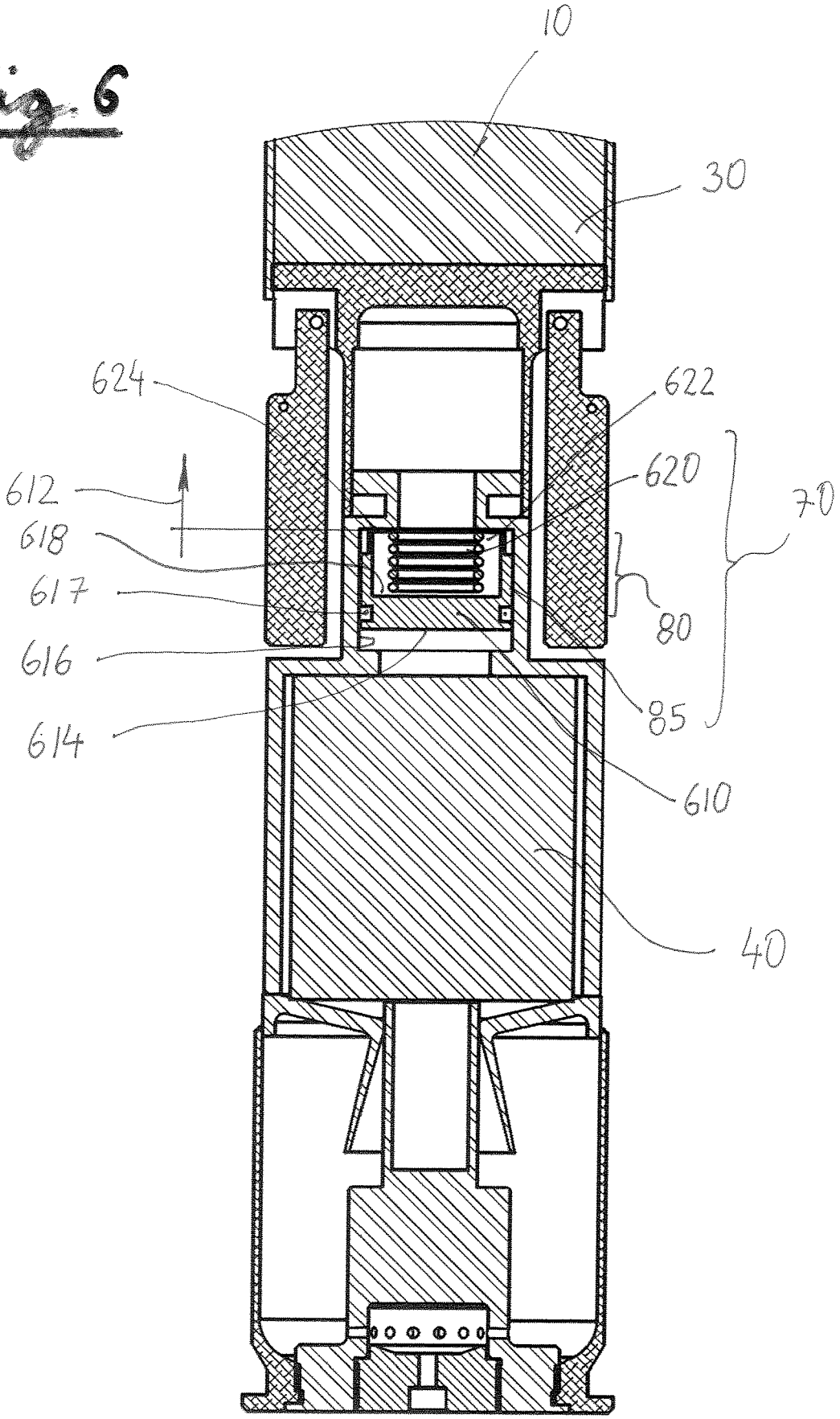
FIG. 6 is a close-up cross-section view of the cutting and separation assembly according to the invention, as embodied in the armament illustrated in FIG. 1.
Figure 7:
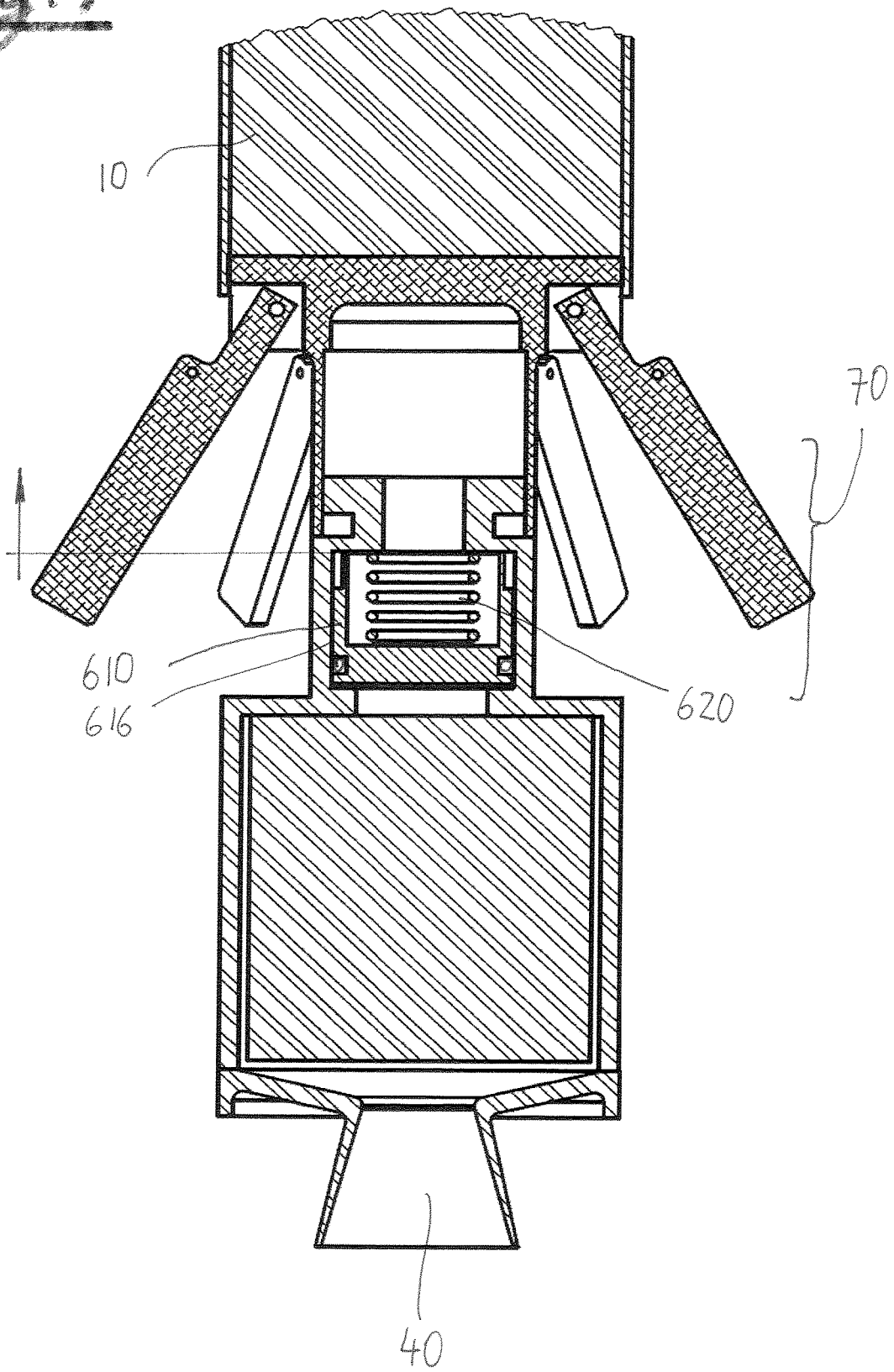
FIG. 7 is a close-up cross-section view illustrating the mode of operation of the cutting and separation assembly illustrated in FIG. 6 in the first stage, just after the ejection of the armament from the tubular launcher while igniting the rocket motor—starting a cutting piston movement.
Figure 8:
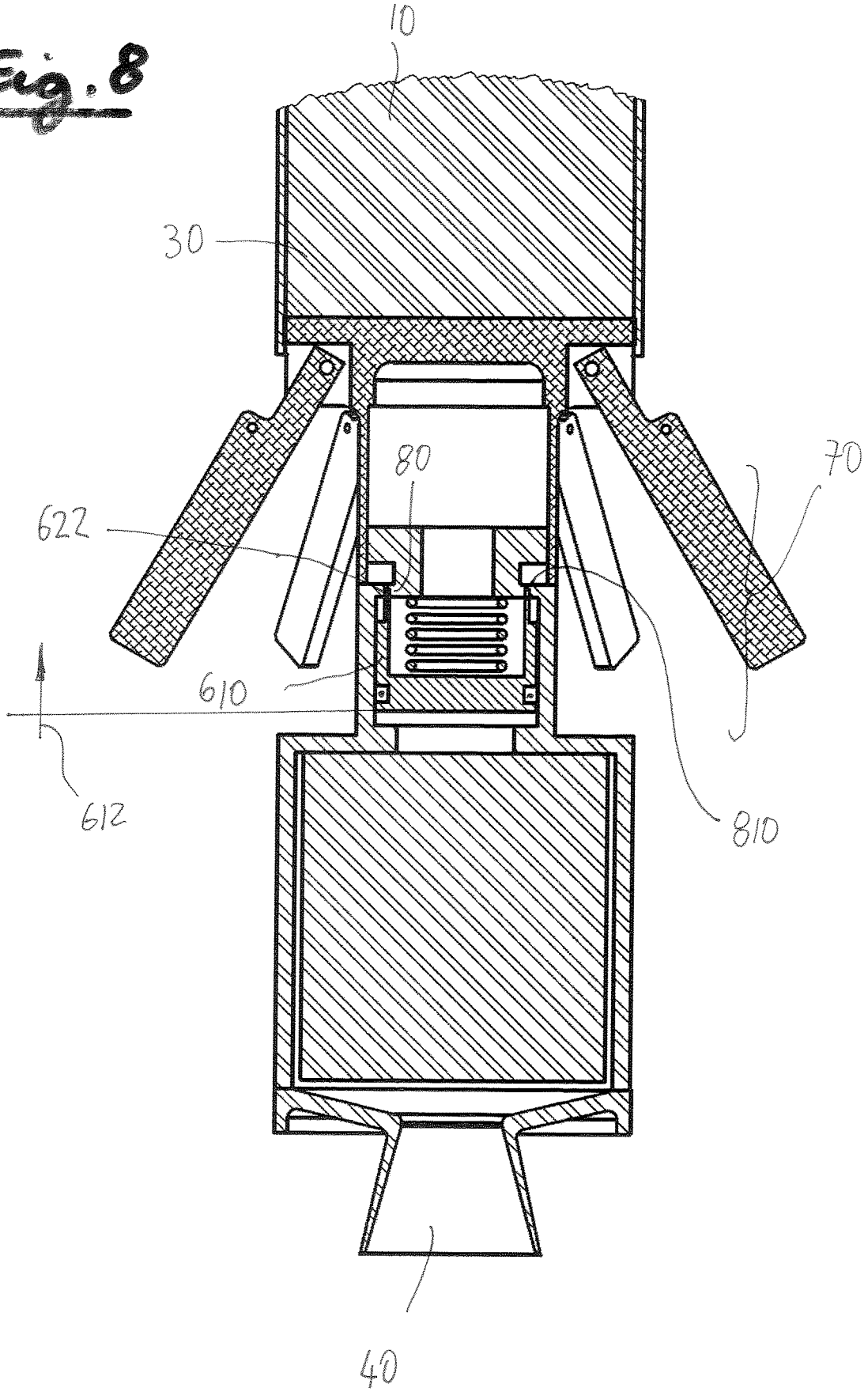
FIG. 8 is a close-up cross-section view of another stage in the mode of operation of the cutting and separation assembly illustrated in FIG. 6. During the flight of the armament towards the target, the cutting piston starts the mechanical cutting of the structural connection between the rocket motor and the effective payload.
Figure 9:
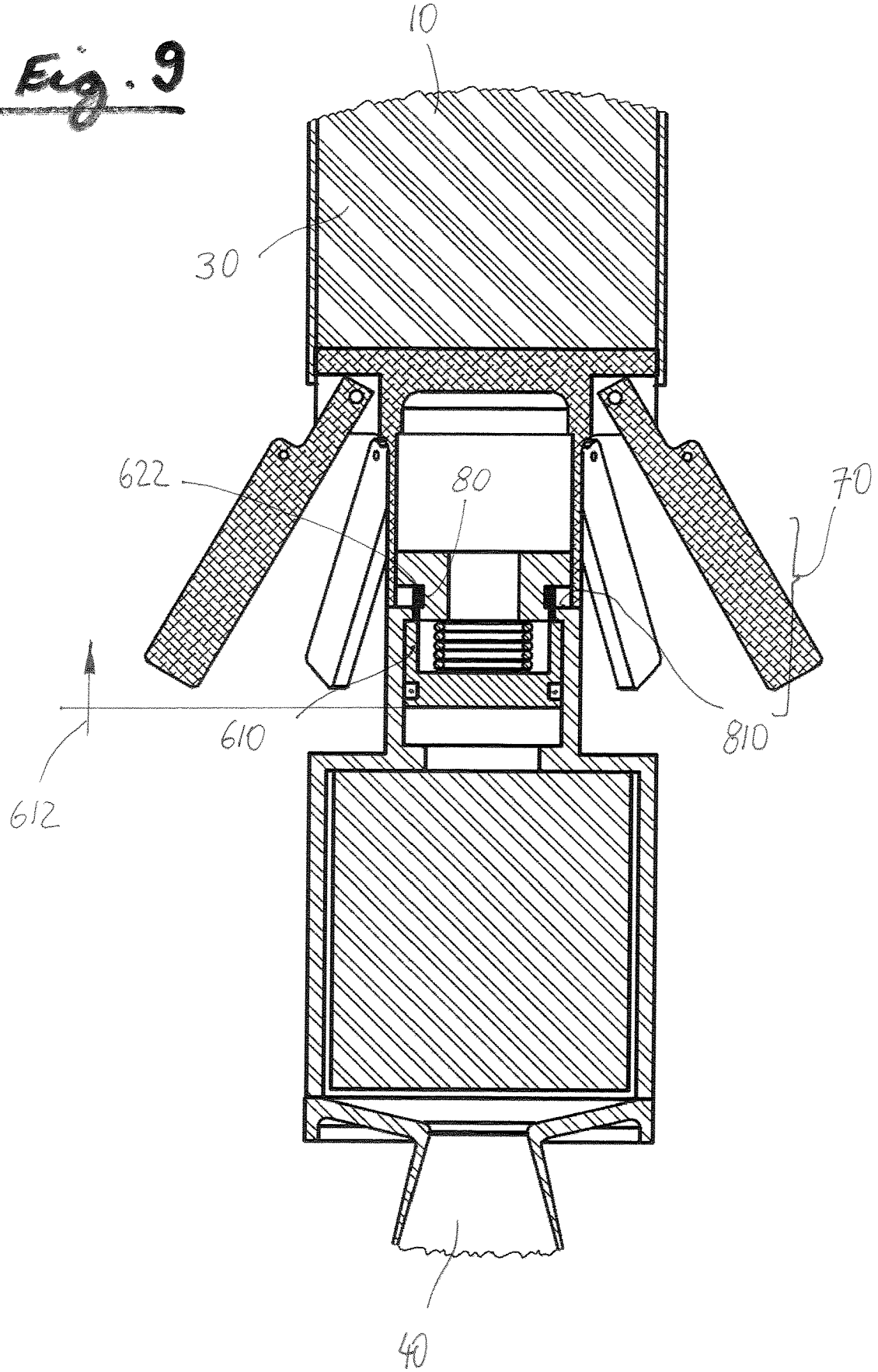
FIG. 9 is a close-up cross-section view illustrating another stage in the mode of operation of the cutting and separation assembly illustrated in FIG. 6. During the flight of the armament towards the target, the cutting piston completes the mechanical cutting of the structural connection between the rocket motor and the effective payload.
Figure 10:
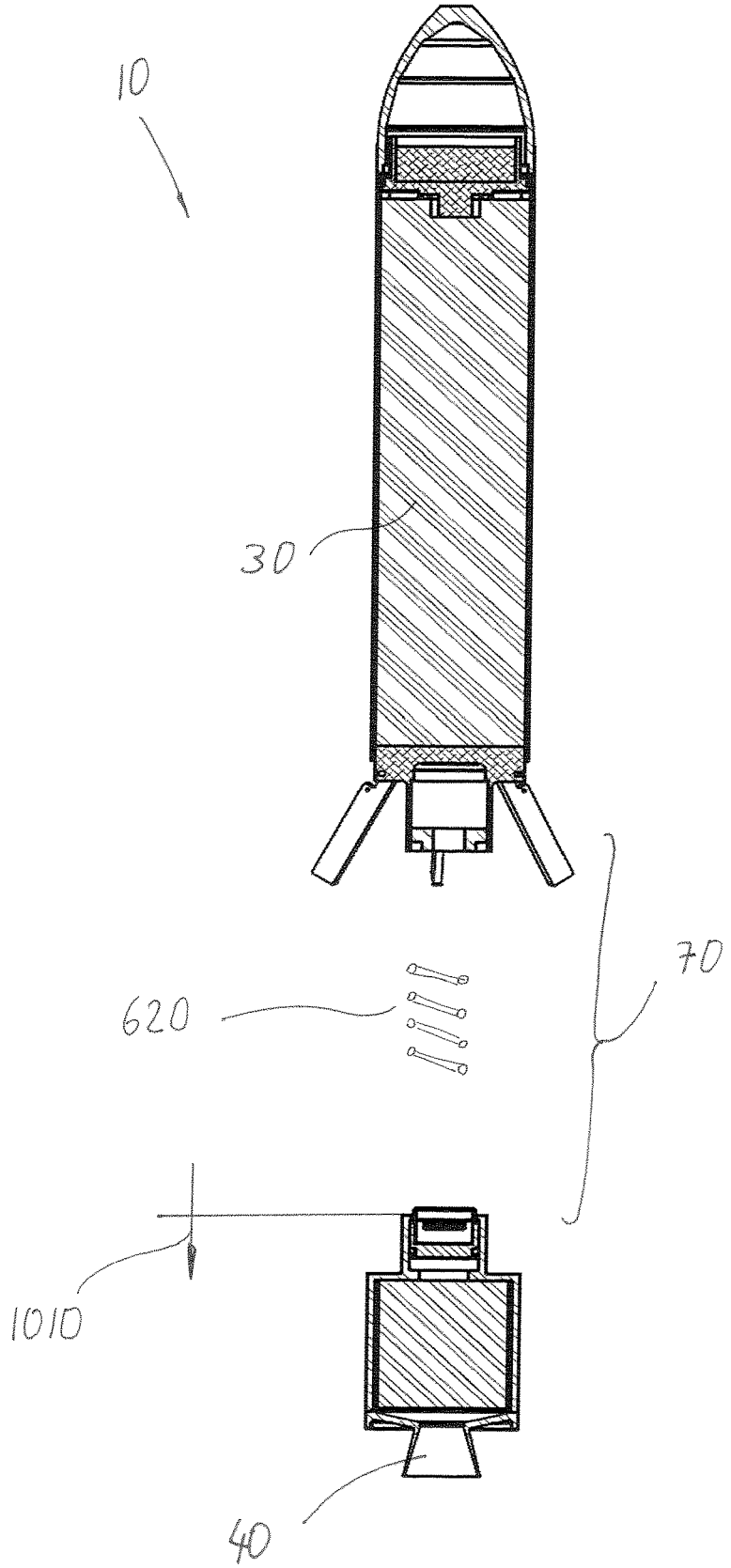
FIG. 10 is a close-up cross-section view of the final stage in the mode of operation of the cutting and separation assembly illustrated in FIG. 6. During the flight of the armament towards the target, the rocket motor and the armament's effective payload are separated from each other.

Reference is made to FIGS. 6-10. FIG. 6 is a close-up cross-section view of cutting and separation assembly 70, as embodied in armament 10. FIG. 7 is a close-up cross-section view of the first stage of the mode of operation of cutting and separation assembly 70, just after ejection of armament 10 from tubular launcher 20 (not illustrated), while igniting rocket motor 40—the beginning of the movement of cutting piston 610. FIG. 8 is a close-up view of another stage in the mode of operation of cutting and separation assembly 70. During the flight of the armament towards its target, cutting piston 610 begins to mechanically cut structural connection 80 between rocket motor 40 and effective payload 30. FIG. 9 is a close-up view of a cross-section of another stage in the mode of operation of cutting and separation assembly 70. During the flight of the armament towards its target, cutting piston 610 completes the mechanical cutting of structural connection 80 between the rocket motor and the effective payload. FIG. 10 is a close-up view in cross-section of the final stage in the mode of operation of cutting and separation assembly 70. During the flight of the armament towards the target, the rocket motor and the armament are separated from each other.

According to the illustrated example, cutting and separation assembly 70 comprises cutting piston 610, which is positioned at the end of rocket motor 40 and is adjusted to a linear movement (in the direction of arrow 612) by the gas pressure generated by the combustion of the rocket motor propellant inside the rocket motor, and exerts pressure on one side—614 of the cutting piston. Rocket motor 40 is formed with sliding track 616 (in the illustrated example, the track is formed as a cylindrical seating). Within sliding track 616, cutting piston 610 is adapted to move from the time it is stressed as stated by the force of the gas pressure generated from the combustion of the rocket motor propellant. Also according to the illustrated example, o-ring gasket 617 is positioned between the surface of the cutting piston and the sliding track to prevent gas leakage. Cutting piston 610 is stressed on the other side—618 by springy means 620 (a spiral spring according to the illustrated example, but any skilled person will understand that this is only an example, and that another device can be used as a springy means, such as one or more springy disks). Springy means 620 rests on structural connection 80 (in the illustrated example—threaded interface 85), which normally harnesses rocket motor 40 to effective payload 30 (to create a single unified armament unit). Springy means 620 is positioned inside seating member 622 that is formed in the cutting piston. Cutting piston 610 is formed around seating 622 with circumferential cutting edge 624.

Immediately after the ejection of the armament from the launcher (the state illustrated in FIG. 7), cutting piston 610 starts to accelerate in a linear movement (in the direction of arrow 612) by the force of the gas pressure that is forming, as stated, from the combustion of the rocket motor propellant. The cutting piston movement takes place inside sliding track 616, while compressing springy means 620. In continuation of the cutting piston movement (in the state illustrated in FIG. 8), from the time of the physical engagement between circumferential cutting edge 622 of the piston and wall 810 (a wall which forms part of structural connection 80 that harnesses rocket motor 40 to effective payload 30), due to the force exerted by the gas pressure, the circumferential cutting edge starts to exert shearing force on the wall, while overcoming the force of the springy means force, and cuts the wall. Circumferential cutting edge 622 completes the cutting of wall 810 (the state illustrated in FIG. 9), and therefore cuts structural connection 80 between rocket motor 40 and effective payload 30. In the next stage (the state illustrated in FIG. 10), rocket motor 40 is detached and separated from effective payload 30 during the flight of the armament. Rocket motor 40 exhausts its energetic ability and is thrust in a relatively backward motion (in the direction of arrow 1010) with the aid of springy means 620.

According to the illustrated example, the structural connection is cut by a circumferential cutting edge that is stressed against a wall, but any skilled person would understand that such a mechanical cutting effect could also be achieved by stress exerted by another means against a different member (e.g. local shearing of mechanical connection pins). In addition, according to the illustrated example, the backward thrust of the rocket motor after its separation from the effective payload is assisted by a springy means (spiral spring in the illustrated example), but any skilled person will understand that such a thrust effect could also be achieved by utilizing the aerodynamic drag of the motor body itself (and particularly combined with the action of such springy means). Furthermore, the disengagement can be facilitated by the implementation of a bearing device (e.g. a linear bearing or applying low friction coefficient coatings on the relevant contact surfaces).

Any skilled person will appreciate that the mode of operation of the cutting and separation assembly according to the invention applies a general method that is also applicable to various other rocket-based armaments. The method is applicable to armaments in which there is a structural connection between the rocket motor and the effective payload, which enables mechanically cutting the connection while utilizing for this purpose the pressure of the rocket motor gases and separating the rocket motor from the effective payload during the flight of the armament. This general method, which includes the stages of moving a cutting piston in a linear motion by the force generated by the gas pressure that forms from the combustion of the propellant of the rocket towards the structural connection between the rocket motor and the effective payload; exerting shearing effort by the cutting piston on the structural connection and separating it by a cut; and separating the rocket motor from the effective payload once the cut has been completed.

Thus, any skilled person will appreciate the fact that the implementation of the invention will minimize the safety risks posed by rocket armament that can be carried and launched by the individual soldier, and improve their effective launch. In one aspect—the embodiment of a gas dispersion assembly, such as assembly 60, which we explained above in referring to the accompanying drawings, the embodiment of the invention may reduce the risks of bodily injury to the combatant or to combatants in immediate proximity from such armaments due to the inadvertent and undesired actuation of the armament. In another aspect (either applicable separately or in combination with the first one)—the embodiment of a cutting and separation assembly, such as assembly 70, which we explained above in referring to the accompanying drawings, the embodiment of the invention may improve aerodynamic performances of such armaments (riddance of the heavy body member of the rocket motor just after its operation has been completed), and by reducing the risks of bodily injury to the combatant launching the armament and to his immediate surroundings, as a result of the backward thrust of the heavy body member of the rocket motor and the possibility of the spray of dangerous shrapnel.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

The invention claimed is:

1. A rocket-based armament launchable from a tubular launcher that comprises:

an effective payload;

a rocket motor that is structurally connected to the effective payload and is adapted from the time of an ignition of the rocket motor to propel the effective payload; and a pyrotechnic assembly that has been adapted, once actuated, to eject the rocket motor and said effective payload from said tubular launcher and to ignite said rocket motor;

wherein said armament is characterized in that said armament also comprises:

a. a gas dispersion assembly which, when said rocket armament is not encased in the tubular launcher, prevents the ignition of said rocket motor even if said pyrotechnic assembly is actuated, said dispersion assembly comprising:

a dispersing openings array that is connected to a flow of gas mass-produced by the actuation of said pyrotechnic assembly, and is encaseable by an interior surface of said tubular launcher in a manner that prevents dispersion of gas through the gas dispersion assembly; and a bushing member that is formed as a piston, one end of which is located inside an ejection nozzle of said rocket motor, in a manner that prevents the ignition of the rocket motor by the force of the gas mass-produced by the actuation of said pyrotechnic assembly, if said dispersing openings array is not encased, and therefore enables the dispersion of gases through the gas dispersion assembly; and b. a cutting and separation assembly that is actuated by gas pressure from said rocket motor for mechanically cutting a structural connection between the rocket motor and the effective payload and separate the rocket motor and the effective payload during flight.

2. The rocket armament of claim 1, wherein said cutting and separation assembly comprises:

a cutting piston located at an end of said rocket motor and stressed on a side by gas pressure that is formed by the ignition of said rocket motor in a linear motion towards said structural connection between the rocket motor and the effective payload to mechanically cut the structural connection; and a springy means that rests on said structural connection and stresses said cutting piston on another side opposite the linear motion, and once the structural connection is cut, the cutting and separation assembly helps to thrust said rocket motor and separate the rocket motor from the effective payload.

3. The rocket armament of claim 1, wherein said armament is a 40 mm armament that is launchable from said tubular launcher, wherein the tubular launcher is a grenade launcher or a single-use disposable canister.

4. A gas dispersion assembly of a pyrotechnic assembly that can be fitted in a rocket-based armament that is launchable from a tubular launcher, wherein said gas dispersion assembly comprises:

a dispersing openings array that is connected to a flow of gas mass-produced by an actuation of said pyrotechnic assembly, and is encaseable by an interior surface of said tubular launcher in a manner that prevents dispersion of gas through the gas dispersion assembly; and a bushing member that is formed as a piston, one end of which is located inside an ejection nozzle of said rocket motor, in a manner that prevents the ignition of the rocket motor by the force of the gas mass-produced by the actuation of said pyrotechnic assembly, if said dispersing openings array is not encased, and therefore enables the dispersion of gases through said array;

wherein the gas dispersion assembly is configured to prevent the ignition of the rocket motor of said armament when the rocket armament is not encased in the tubular launcher, even if said pyrotechnic assembly is actuated.

5. A cutting and separation assembly, comprising:

a cutting piston located at an end of a rocket motor of a rocket armament and stressed on a side by gas pressure that forms from an ignition of said rocket motor to a linear motion towards a structural connection between the rocket motor and an effective payload of the rocket armament to mechanically cut the structural connection;

a springy means that rests on said structural connection and stresses said cutting piston on another side opposite said linear motion, and once the structural connection is cut, the cutting and separation assembly helps to thrust said rocket motor and separate the rocket motor from the effective payload;

a dispersing openings array that is connected to a flow of gas and is encaseable by an interior surface of a tubular launcher; and a bushing member that is formed as a piston, one end of which is located inside an ejection nozzle of said rocket motor, in a manner that prevents the ignition of the rocket motor by the flow of gas if the dispersing openings array is not encased;

wherein the cutting and separation assembly is actuated by gas pressure from the rocket motor to mechanically cut the structural connection between the rocket motor and the effective payload and separate the rocket motor and the effective payload during flight.

* * * * *